US006695936B2

(12) United States Patent
Johnson

(10) Patent No.: US 6,695,936 B2
(45) Date of Patent: Feb. 24, 2004

(54) METHODS AND APPARATUS FOR USING LARGE INERTIAL BODY FORCES TO IDENTIFY, PROCESS AND MANUFACTURE MULTICOMPONENT BULK METALLIC GLASS FORMING ALLOYS, AND COMPONENTS FABRICATED THEREFROM

(75) Inventor: William L. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 23 days.

(21) Appl. No.: 09/991,802

(22) Filed: Nov. 14, 2001

(65) Prior Publication Data

US 2002/0112790 A1 Aug. 22, 2002

Related U.S. Application Data

(60) Provisional application No. 60/248,901, filed on Nov. 14, 2000, and provisional application No. 60/271,188, filed on Feb. 23, 2001.

(51) Int. Cl.[7] ..... C21D 1/54

(52) U.S. Cl. ..... 148/508; 148/403; 148/539; 75/375; 75/384; 75/386

(58) Field of Search ..... 148/508, 403, 148/538, 539; 75/375, 384, 386; 164/118, 290

(56) References Cited

U.S. PATENT DOCUMENTS

| | | | | |
|---|---|---|---|---|
| 2,209,935 A | * | 7/1940 | Samuels | 75/375 |
| 4,007,771 A | | 2/1977 | Welsch | |
| 4,063,721 A | | 12/1977 | Leis | |
| 5,288,344 A | | 2/1994 | Peker et al. | |
| 5,296,059 A | | 3/1994 | Masumoto et al. | |
| 5,306,463 A | | 4/1994 | Horimura | |
| 5,312,495 A | | 5/1994 | Masumoto et al. | |
| 5,324,368 A | | 6/1994 | Masumoto et al. | |
| 5,368,659 A | | 11/1994 | Peker et al. | |
| 5,589,012 A | | 12/1996 | Hobby et al. | |
| 5,711,363 A | | 1/1998 | Scruggs et al. | |
| 5,735,975 A | | 4/1998 | Lin et al. | |
| 5,797,443 A | | 8/1998 | Lin et al. | |
| 5,950,704 A | | 9/1999 | Johnson et al. | |

FOREIGN PATENT DOCUMENTS

| | | |
|---|---|---|
| JP | 56 112429 | 9/1981 |

OTHER PUBLICATIONS

Partial International Search Results from PCT Application No. US 01/436665 dated Nov. 4, 2002.

* cited by examiner

*Primary Examiner*—Scott Kastler
(74) *Attorney, Agent, or Firm*—Knobbe, Martens, Olson & Bear, LLP

(57) ABSTRACT

To identify and manufacture metallic glass forming alloys, large inertial forces or "g"-forces are used to sequentially separate crystalline phases (particles) as they sequentially form and grow in a molten alloy during gradual cooling of the alloy below its liquidus temperature. These forces physically remove and isolate the actual crystalline particles from the remaining liquid as they are formed. Under the influence of a large g-force, this is accomplished by rapid and efficient sedimentation and stratification. Further contamination and nascent solid "debris" in the form of oxides, carbides, or other foreign particles can be removed from the molten alloy using the same sedimentation/stratification technique. Finally, a method of efficiently cooling and solidifying the final low melting stratified and decontaminated liquid into a solid glass component is proposed which utilizes convective heat transport by a cooling gas. The result is a vitrified bulk metallic glass component of near net shape.

37 Claims, 11 Drawing Sheets

METHODS AND APPARATUS FOR USING LARGE INERTIAL BODY FORCES TO IDENTIFY, PROCESS AND MANUFACTURE MULTICOMPONENT BULK METALLIC GLASS FORMING ALLOYS, AND COMPONENTS FABRICATED THEREFROM

CROSS-REFERENCE TO RELATED APPLICATIONS

This application claims the benefit of U.S. Provisional Application No. 60/248,901, filed Nov. 14, 2000, and U.S. Provisional Application No. 60/271,188, filed Feb. 23, 2001, the entirety of both of which are hereby incorporated by reference.

BACKGROUND OF THE INVENTION

1. Field of the Invention

This invention relates to a method and apparatus for the identification and processing of bulk metallic glass forming alloys, and the manufacture of components fabricated from these alloys.

2. Description of the Related Art

During the past decade, numerous university and industrial research groups have invested significant efforts to discover metal alloy formulations which form glass when cooled from the molten state at relatively slow rates of cooling. Vitrification or glass formation in metal alloys was first discovered in about 1960 by P. Duwez and coworkers at the California Institute of Technology ("Caltech"). They used "rapid solidification" techniques to produce glassy alloys by cooling the liquid alloy at rates of about 1 million degrees per second. A variety of such rapidly quenched metallic glasses were produced over the following three decades.

Beginning in about 1990, the research groups of Prof. A. Inoue in Japan and Prof. W. L. Johnson at Caltech developed complex alloys containing 3, 4, 5 or more components which formed glasses at far lower cooling rates, typically 1–100 degrees per second when solidified from the equilibrium liquid state. During the past several years, these "bulk" glass forming alloys have attracted substantial commercial interest as engineering materials. The bulk metallic glasses have high strength, high hardness, high specific strength, and a variety of other useful engineering properties. Furthermore, the liquid alloys are highly processable and can be cast into complex three dimensional very near net shapes. Interest in utilizing these materials in engineering applications has led to widespread interest in developing and discovering new bulk glass forming alloys, in processing these alloys from the melt, and utilizing these alloys to produce commercially useful materials such as rods, plates, sheets, tubes, and other more complex shapes.

A key parameter which distinguishes alloys with exceptional glass forming ability is their relatively low melting point. Alloys which form bulk metallic glass undergo equilibrium melting of the initial alloy over a range of temperatures which are relatively low compared with the compositionally averaged melting point of the pure metals which comprise the alloy. Very often, the optimum glass forming alloy lies near a minimum in the melting surface (liquidus surface) of the alloy taken as a function of the alloy composition. This liquidus surface is conventionally represented in alloy phase diagrams as a "liquidus projection." For example, in a two component alloy, the liquidus curve can be represented as a curve in the composition/temperature plane.

A simple example is shown in the Au—Si phase diagram of FIG. 1. This phase diagram of binary Au—Si alloy shows a eutectic composition 10 with a eutectic temperature 12 of 363° C. The liquidus line 14 represents the line above which a single liquid phase is present. The solidus line 16 represents the line below which the system has completely solidified. Note that the melting point of Au is about 1064° C. and that of Si is about 1414° C. Also illustrated is the compositional partitioning of a slowly cooled liquid at an off-eutectic composition 18 during solidification where $x_L$ is the composition of the remaining liquid.

In this simple binary case, the eutectic composition is precisely the compositional range where Duwez and coworkers produced the first metallic glass by rapid quenching. More generally, low lying liquidus temperatures (e.g. near alloy eutectic compositions) locate the optimum glass forming regions in higher order ternary, quaternary, quinary, etc. glass forming alloys. See W. L. Johnson, 24 *Materials Research Society Bulletin* 42–56 (October 1999). Generally speaking, the ability to form metallic glass is optimized at or near eutectic compositions, or more generally near the lowest lying temperatures of the liquidus surface in ternary, quaternary and higher order alloys. As such, the search for easy glass forming alloys is very frequently found to be equivalent to finding those alloy compositions corresponding to the lowest lying melting temperatures (or lowest lying liquidus surface). Most often, the best glass forming alloys lie within about ±5 at. % of a minimum in the liquidus surface. The search for easy glass forming alloys is thus dramatically simplified when the lowest melting alloys can be identified.

To locate glass forming compositions, it is critical to be able to identify or "discover" alloys with chemical compositions located near the lowest lying regions of the melting curves in the higher order alloys. Thus, it is of interest to develop an efficient means of both discovering and isolating the lowest melting alloys in a complex multicomponent alloys system containing two, preferably three or more metals. In the case of alloys with more than three components, the phase diagrams are generally not available and little or no information exists to guide the researcher to the optimum low melting compositions.

It has actually been proposed to develop materials combinatory methods whereby one searches for low melting alloys by literally making thousands of alloy compositions (using for example thin film processing methods) and screening their melting points in a rapid and parallel manner. See 159 Chem. Week 57 (1997). This approach requires carrying out literally thousands or tens of thousands of screening experiments. Thus, what is needed is a method of identifying the lowest melting alloy in a single or small number of experiments on a bulk liquid.

The production of bulk metallic glass, in addition to developing low melting point alloys, also requires that the low melting liquid alloy be substantially free of contaminants, oxides, and debris which induce crystallization. For metals, the most frequently encountered contamination of the liquid is in the form of crystalline oxide particles, carbide particles, and a variety of other types of nascent foreign substances. These contaminants are ubiquitous and ever present in the processing of nearly all commercial metals used in casting of metallic components. In most common cases (e.g., casting of aluminum, iron, and titanium alloys), they are inevitable inclusions in the liquid. It is well known that this nascent contamination frequently induces crystallization of the liquid alloy when it is undercooled below its melting point. Metallurgists refer to this as heterogeneous crystal nucleation. Practically speaking, heterogeneous nucleation is extremely harmful to the glass forming ability of metal alloys. As such, it would be extremely desirable to develop methods to reduce or eliminate nascent oxide, carbide, and other debris from metallic melts when attempting to produce metallic glass. Thus, what is needed is a direct and efficient means of removing most or nearly all of this nascent contamination and debris from a molten alloy.

Finally, it is of importance to produce bulk metallic glass in useful shapes. What is needed is a natural means of efficiently cooling and solidifying or casting a "decontaminated" alloy with an optimized composition (having the lowest melting point) into plates, rods, tubes, or other very near net shape castings.

SUMMARY OF THE INVENTION

The preferred embodiments of the present invention address these and other needs by providing a rapid and efficient method to identify and physically isolate alloy compositions of low melting alloys which readily form bulk metallic glass. Certain preferred embodiments also process these materials in a manner which removes unwanted and harmful impurities and debris (such as crystalline oxide, carbide or nitride particles) in the molten alloy to improve the glass forming ability of the liquid alloy. Preferred embodiments also describe the production and manufacture of large net shape castings, plates, rods, and other useful shapes from the purified and compositionally optimized liquid alloy.

In one aspect of the present invention, a method of identifying the lowest melting eutectic composition of an alloy having "n" phases is provided, where $n \geqq 2$. An arbitrary starting alloy is provided. The alloy is heated until it is substantially molten. Preferably, the molten alloy is subjected to an inertial force above its melting point for a period of time. The temperature of the alloy is lowered while subjecting the alloy to a large inertial force or acceleration. An inertial acceleration is often also referred to as gravitational acceleration or simply gravity where the gravity and acceleration have the opposite sense. The lowering of the temperature causes nucleation and growth of crystals of a first crystalline solid phase within surrounding liquid.

Crystals of the first solid phase are subjected a body or inertial force preferably caused by inertial acceleration or gravity) such that the first solid phase moves either upward or downward (with respect to the direction of the inertial acceleration) in the remaining liquid. As used herein, upward and downward (as well as top and bottom) do not necessarily refer to the ordinary meanings of these terms, but rather indicate direction with respect to the inertial acceleration, where bottom is opposite the direction of acceleration (or along the direction of applied gravity). The direction of motion (i.e., upward or downward) depends on the sign of the density difference between the crystals and the surrounding liquid. Heavier crystals move opposite to the direction of inertial acceleration; lighter crystals move along the direction of the inertial acceleration. This process is commonly referred to as sedimentation.

Further lowering of the temperature of the alloy while subjecting the alloy to said inertial acceleration and body forces causes further nucleation and growth of additional solid phases, the additional solid phase crystals being subjected to the inertial forces such that the additional solid phases move upward or downward, depending on the sign of the difference in density between these crystals and the remaining liquid. Thus, as crystalline phases are sequentially formed, the crystals sediment to the top or bottom of the liquid forming strata at the top and bottom of the vessel which contains the liquid.

The temperature is further lowered until the alloy is substantially completely solidified. The last solid phase to solidify is desirably located between the previously solidified strata. However, it will be appreciated that where the solid phases have substantially the same density, the last solid phase to solidify does not necessarily have to be between other previously solidified strata. The final liquid will have the lowest melting point of all the solidified strata. In the case where this final liquid has a eutectic composition with a minimum melting temperature, the final liquid remaining will solidify at the eutectic composition in a well defined layer or strata. An alloy of eutectic composition will be physically isolated in a well-defined layer.

In another aspect of the present invention, a method of producing a bulk sample of a lowest melting eutectic composition of an alloy is provided. An arbitrary starting alloy is provided. The temperature of the alloy is lowered while subjecting the alloy to an inertial force, the lowering of the temperature causing nucleation and growth of a first solid phase within surrounding liquid. The first solid phase is subjected to the inertial force such that the first solid phase moves upward or downward in the surrounding liquid. Further lowering of the temperature of the alloy while subjecting the alloy to said force causes further nucleation and growth of additional solid phases, the additional solid phases being subjected to the inertial force such that the additional solid phases move upward or downward. The temperature is further lowered until the alloy is substantially completely solidified. A bulk sample of alloy is then removed from the strata or layer which was the last to solidify. This lowest melting sample is then remelted and cast in an effort to produce a bulk glass casting having the composition of this lowest melting alloy.

In another aspect of the present invention, a method of processing a multicomponent alloy, comprising melting the alloy and subsequently solidifying the alloy, both operations being carried out in the presence of a centripetal acceleration field. In one embodiment, the alloy is solidified in the presence of an inertial acceleration or g field of between about 1 and $10^6$ g's produced by centrifugal motion. Here, g is the acceleration of the Earth's gravitational field=9.8 $m/s^2$.

In another aspect of the present invention, a method of forming a purified, multicomponent bulk metallic glass forming alloy is provided. A sample alloy is melted at an elevated temperature. The molten alloy is subjected to a centripetal acceleration while holding it above the melting point for a period of time. The alloy is solidified by lowering the temperature of the alloy while continuing to subject the alloy to a centripetal acceleration, the solidified alloy having a portion separated from the remaining alloy having a lowest melting eutectic composition. The portion of the alloy having the lowest melting eutectic composition is isolated. The portion of the alloy having the lowest melting eutectic composition is re-melted at an elevated temperature while subjecting this portion to a centripetal acceleration. The portion of the alloy having the lowest melting eutectic composition is cooled while subjecting the portion to a centripetal field, the cooled alloy having a portion with relatively fewer impurities than the remaining alloy.

In another aspect of the present invention, a metallic alloy having a composition optimized for bulk glass forming ability is provided. The composition is obtained by melting the alloy followed by a slow and gradual cooling and solidification of an initially molten alloy in a centrifuge. The centrifuge subjects the alloy to high inertial forces during solidification which physically separates crystalline phases from the remaining molten alloy, such that the optimized composition of the metallic alloy is the last portion of the alloy to solidify and is physically isolated in a well-defined layer of the final alloy.

In another aspect of the present invention, a high temperature centrifugal processing device for processing molten metal alloys under very high inertial accelerations is provided. A rotor is fabricated of a high temperature material having high strength and fracture resistance at temperatures of between about 400 and 1200° C. and which is capable of withstanding inertial accelerations up to at least 50,000 g's. A plurality of internal cavities within the rotor symmetrically laid out within the body of the rotor. A shaft onto which the rotor is mounted allows the rotor to be spun at high rotation frequencies of between about 1000 and 100,000 rpm.

DETAILED DESCRIPTION OF THE PREFERRED EMBODIMENTS

The preferred embodiments illustrated herein describe a method for identifying, processing and manufacturing a metallic glass forming alloy, and preferred apparatuses for accomplishing these methods. More particularly, certain preferred embodiments describe the use of a centrifuge to create a centripetal force on a molten alloy as it is cooled in order to separate out the desired alloy composition and remove impurities. It will be appreciated, however, that other methods and devices may also be used to produce the desired separation. It will also be appreciated that the methods described herein may have applicability to beyond metallic glass forming alloys.

Stratification Sedimentation and Fluid Mechanics

To accomplish the objectives outlined above, in one embodiment large inertial forces or "g"-forces are utilized to sequentially separate crystalline phases (particles) as they sequentially form and grow in a molten alloy during gradual cooling below the liquidus temperature. The crystalline particles are physically removed and isolated from the remaining liquid as they are formed. Under the influence of a large g-force, this is accomplished by rapid and efficient sedimentation and stratification. Further, contamination and nascent solid "debris" in the form of oxides, carbides, or other foreign particles from the molten alloy can be removed using the same sedimentation/stratification technique. The resulting liquid is a final low melting stratified and decontaminated liquid, which can be efficiently cooled and solidified into a solid glass component, such as by utilizing convective heat transport by a cooling gas. This results in a vitrified bulk metallic glass component of near net shape.

The large inertial or g-forces are preferably generated in one embodiment by the rotational motion of a centrifuge. Using one of a number of centrifuge designs, inertial acceleration a can be produced, for example ranging from about 1 to $10^6$ g's. Here g is the acceleration of gravity (9.8 m/s$^2$). Using more advanced centrifuges, inertial acceleration of about $10^5$ to $10^6$ g's or more can be generated. This results in a body force density ρ a per unit volume exerted on any object rotating with the centrifuge where ρ is the density of the object. More particularly, a solid particle located in a liquid will be subjected to a net body force density given by:

$$f=(\rho_s-\rho_L)a=\Delta\rho a$$

where $\rho_s$=density of the solid particle in kg/m$^3$ and $\rho_L$=density of the carrier liquid in kg/m$^3$. For a solid particle of volume V, this results in a net body force of $F=f\Omega=\Delta\rho a\Omega$. This well known body force causes the solid particle to move or sediment in the g-field and is responsible for the well known phenomena of sedimentation.

Figure 2:
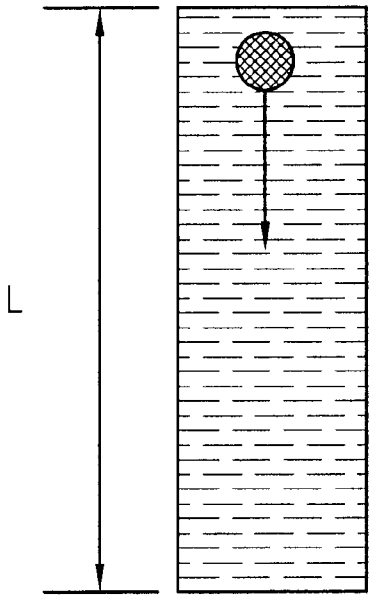
FIG. 2 is a schematic illustration of a solid spherical particle located in a liquid and falling in a centripetal g-field.

To illustrate, consider a solid particle in a liquid column as shown in FIG. 2. Assuming laminar flow, the drift velocity v of the solid particle in the liquid can be calculated by knowing the viscosity of the liquid. For example, in the case of a simple spherical particle, this is given by equating the frictional drag on the particle to the body force and is given by the following equation:

$$\Delta\rho a\Omega=3\pi\mu v\ d \tag{1}$$

or $$v=[\Delta\rho a\Omega]/[3\pi\mu d]=[\Delta\rho a\ d^2]/18\ \mu \tag{2}$$

where d is the sphere diameter, $\Omega=(4\pi/3)(d/2)^3=\pi d^3/6$, and $\mu$=liquid viscosity measured in Pa-s. See R. Clift et al., Bubbles, Drops, and Particles 380 (Academic Press 1978), As an example, using $a=10^4$ $g=10^5$ m/s$^2$, d=1 $\mu$m, $\Delta\rho$=500 kg/m$^3$=0.5 g/cc, and $\mu$=0.01 pa-s, gives v=drift velocity= 0.28 mm/s. The time required to sediment the particle a distance L will be $\tau=L/v$. For L=10 cm, this requires about 300 seconds for a 1 micron sphere to "sediment" a distance of 10 cm. For non-spherical particles such as an ellipsoid of non-unit aspect ratio, the time will be shorter.

Sedimentation Purification Rates/Time Scales

For a mixture of "heavy" solid particles in a less dense melt, geologists have shown that melt segregation along a centripetal force field over a column length L can be described by:

$$d[\ln f]/dt=(1/f)df/dt=-v/L \tag{3}$$

where f is the volume fraction of solid phase, and v is the average drift velocity of a solid particle in a liquid in a g-field. See D. McKenzie, *The Generation and Compaction of Partially Molten Rock*, 25 J. PETROL. 713–765.

In a simple approximation, the fraction of solid decreases exponentially at the "top" of the column according to:

$$f=f_0 \exp(-tv/L)=f_0 \exp(-t\Delta\rho a\, d^2/18\,\mu L) \quad (4)$$

where the above expression (2) has been used for the drift velocity v, and $f_0$ refers to the initial volume fraction of solid particles.

The characteristic time scale for exponential decay of the solid volume fraction at the top of the column is:

$$\tau=[\Delta\rho a\, d^2/18\,\mu L]^{-1} \quad (5)$$

If L=10 cm (as above) in a centripetal field of $10^4$ g, then $\tau$=300 seconds for a 1 $\mu$m particle with $\Delta\rho$=0.5 g/cc, and $\mu$=0.01 Pa-s=10 centipoise. In the limit of initial volume fraction of particles, this means the concentration of particles decays by a factor of (1/e) in 300 seconds, or a factor of 10 in about 700 seconds. For a particle of diameter 10 nm, the time scale for purification becomes $3\times10^6$ seconds, or about 3 days. If L=1 cm, the same results are obtained for the 1 $\mu$m particle in about 70 seconds (about 8 hours for the 10 nm particles). This is the characteristic time scale for melt purification with respect to 1 $\mu$m (10 nm) particles. This time scale is proportional to $(1/d^2)$, to $\mu$=viscosity, to (1/a) where a=centripetal acceleration field, and to (1/L) where L=column length. This gives all of the essential physics required to estimate temporal rates of melt purification in a two-phase mixture of liquid containing solid particles (assumed here to be spherical).

Ultimate Purification Levels

Turing now to the ultimate levels of "purification" that can be achieved in a centrifuge, quite generally, one can use the Lamm differential equation to obtain transient and steady state solutions to the problem of particle sedimentation in a centripetal field. See H. Fujita, *Mathematical Theory of Sedimentation Analysis* (Academic Press 1962). To obtain the ultimate steady state concentration profiles in a centripetal field, one can use the Archibald "steady state" solution of the Lamm equation. This is given by:

$$C(r)/C_0=\exp[s\omega^2 r^2/2D]\times[s\omega^2(R_2^2-R_1^2)/2D]/[\exp(s\omega^2R_2^2/2D)-\exp(s\omega^2R_1^2/2D)] \quad (6)$$

where C(r) is the particle concentration (particles/$m^3$) at radial location r, $C_0$ the initial average particle concentration in the sample, s is the sedimentation coefficient of the particles, D is the diffusion constant of the particles, r the radial coordinate of a centrifuge, and $R_1$ and $R_2$ the inner and outer ends, respectively, of a cylindrical sample vile located along the radial arm of the centrifuge rotating at frequency of $\omega$ radians/s.

This steady state solution can be used to compute a steady state partitioning (or "purification") coefficient for the particles. This can be defined as:

$$K=C(R_1)/C(R_2)=\exp[s\omega^2(R_1^2-R_2^2)/2D] \quad (7)$$

The Svedberg relation can be used to determine the ratio s/D. See Fujita above. This is given by:

$$s/D=M(1-\rho_f/\rho_s)/(k_BT) \quad (8)$$

where $\rho_L$ and $\rho_s$ are the respective densities of the carrier liquid and solid particle.

By way of illustration, the partitioning coefficient is calculated for a typical case of a spherical solid particle with density 10% greater than the carrier liquid assumed to have a typical value of 5000 kg/$m^3$. For particles with diameters of 1 $\mu$m and 10 nm (typical cases of practical interest), $M=2.6\times10^{-15}$ and $2.6\times10^{-21}$ kg, respectively. For $k_B=1.38\times10^{-23}$ J/particle-K and T=1000 K (a typical temperature of interest), we have s/D=0.1 $(M/k_BT)$=19 and $1.9\times10^{-2}$ respectively. Applying equation (7) with $R_1$=0.4 m and $R_2$=0.5 m (a sample column height of 10 cm), and $\omega$=500 Hz, one obtains K=exp $(2.14\times10^7)$ and exp $(21.4)=2\times10^9$. In the cage of 1 $\mu$m spheres, purification is essentially complete while for 10 nm spherical solid particles, purification is 2 parts per billion. Accordingly, the method is capable of removing exceedingly small crystalline particles from the melt to a level of parts per billion measured with respect to any initial concentration of particles.

Use of a Centripetal Field During Liquid Alloy Solidification and Crystal Nucleation—Isolation of Lowest Melting Liquid in a Multicomponent Phase Diagrams.

To illustrate the application of the above principles in discovery, isolation, and processing of bulk metallic glass forming alloys, several objectives of certain preferred embodiments are first stated. These are:

(1) Physical separation of the lowest melting eutectic alloy from an arbitrary starting alloy with the goal of "discovering" the lowest melting alloy and physically isolating it.

(2) Elimination of solid crystalline debris or contamination (e.g. oxide particles) from the molten eutectic alloy to optimize glass forming ability.

(3) Production of a bulk metallic glass component from the isolated and purified" lowest melting or eutectic liquid.

Figure 3:
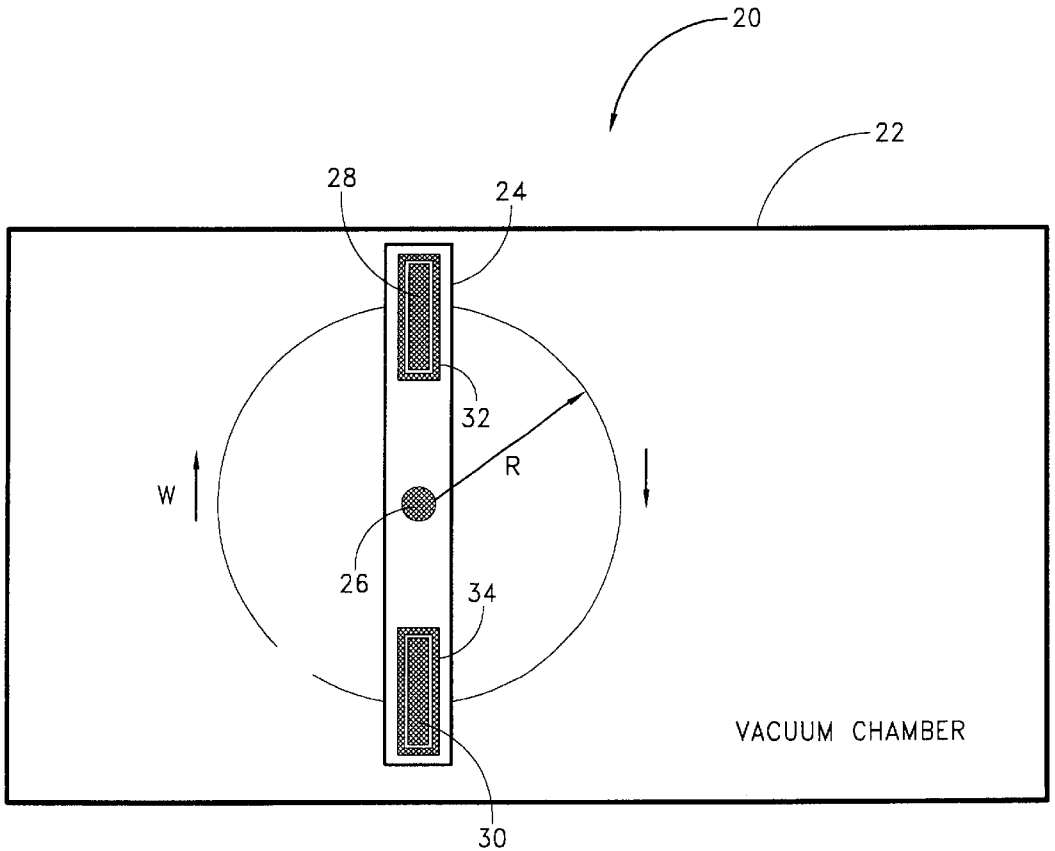
FIG. 3 is a schematic illustration of a centrifuge assembly for determining the lowest melting eutectic composition of a multicomponent alloy.

To accomplish these goals, a liquid alloy in one embodiment is sequentially melted and then gradually solidified by slow cooling in the presence of a centripetal g-field. Preferably, this can be done with a centrifuge equipped with a high temperature furnace. FIG. 3 shows one schematic illustration of the device. Further embodiments of centrifugal devices are described below.

As shown in FIG. 3, the centrifuge assembly 20 is preferably confined in a vacuum chamber 22. A rotor arm 24 rotates about a central axis 26, and twin furnaces 28 and 30 are provided within the arm 24 to control the temperature in the chamber. The alloy samples are loaded in sample holders, described below, which for the purposes of demonstration can be considered to be cylindrical. The sample holders are loaded into cavities 32 and 34 of the arm 24 adjacent each furnace. The assembly is preferably instrumented with rotating high current contacts (not shown) to supply power to the resistively heated furnaces as well as low current rotating contacts for use in external measurements of the furnace temperature using thermocouples.

As illustrated, $\omega$ is the angular frequency of the centrifuge, R is the average radius of the furnace from the centrifuge point of rotation. The acceleration at the furnace will be $a=\omega^2R$. For one preferred device, a rotational frequency of about 5000 rpm, or about 80 rotations/second, equals $(2\pi)^{-1}\omega$, giving $\omega$=500 radians/seconds For this device, R=0.4 m, giving $a=\omega^2R=2.5\times10^5\times0.4$ m/$s^2=10^5$ m/$s^2=10^4$ g.

Figure 1:
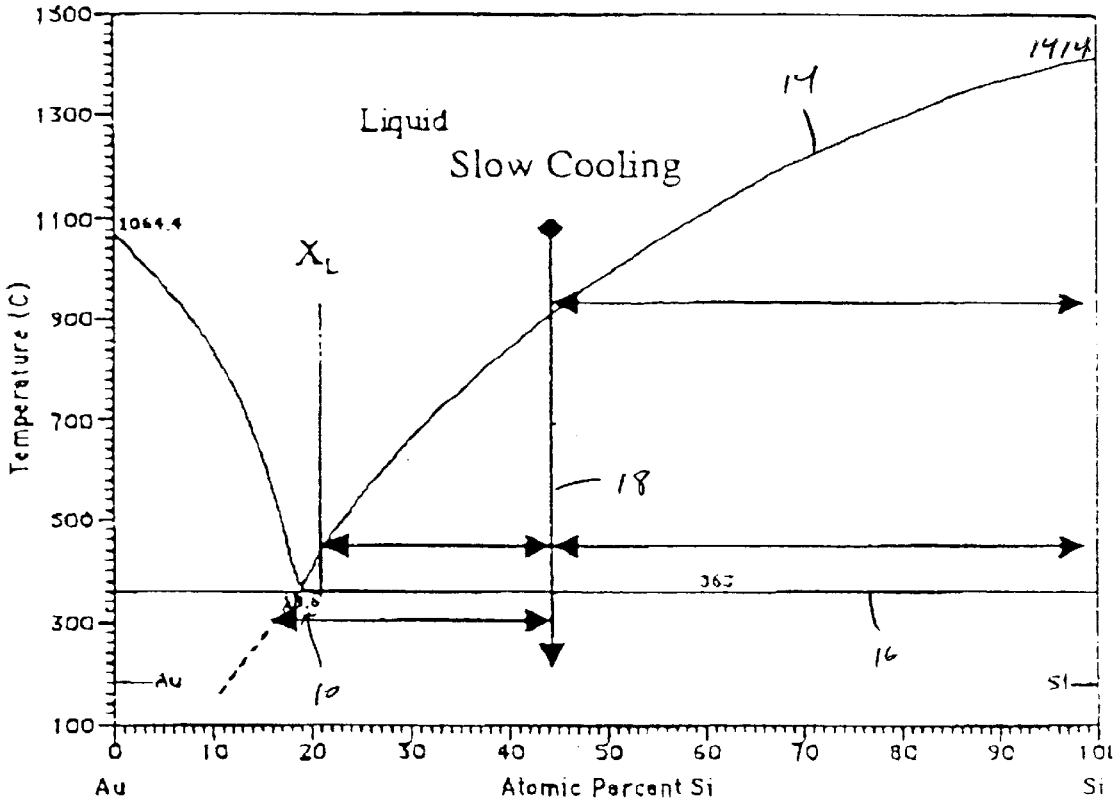
FIG. 1 is a phase diagram of binary Au—Si alloy.

Assuming that the temperature within the cylindrical sample can be varied and maintained uniform (isothermal conditions) within the sample, an alloy having an arbitrary starting composition can be processed as follows. The alloy is first heated above its liquidus temperature until it is completely molten. The temperature is then gradually lowered stepwise until the alloy liquidus curve of the highest melting crystalline phase in the equilibrium diagram is crossed. The alloy is undercooled below this curve until the first crystalline phase (call it the α-phase) nucleates and grows. For the Au—Si system (FIG. 1), at the initial composition shown, this first phase is nearly pure Si having the diamond cubic structure. Being less dense than the remaining liquid, these growing silicon crystals will be subjected to a g-force. For the case considered above, this g-force of about $10^4$ g's, will cause rapid sedimentation to the interior of the centrifuge. If the growing crystals reach only a size scale of about 10 nm, it will take a time scale of hours (note the large density differential $\Delta\rho$ for Au and Si in this case) for sedimentation over a length scale of 10 cm.

The silicon crystals are rapidly and effectively moved to one end of the sample holder leaving the remaining liquid having the composition of the liquidus curve at the temperature of interest. Upon further cooling additional growth of existing silicon crystals along with further nucleation occurs. These crystals are in turn removed to the innermost portion of the centrifuge (as they are less dense than the remaining liquid).

Finally one reaches the solidus curve at 363° C. (for the Au—Si system). Further undercooling ultimately produces nucleation and growth of Au in concert with Si (eutectic solidification). To the extent that the two phases solidify simultaneously by growth of the eutectic microstructure, further sedimentation and segregation is suppressed. The last portion of the sample to solidify will undergo eutectic crystallization at a composition very close the eutectic composition in the phase diagram. Following complete solidification, the sample is cooled to ambient temperature, the centrifuge brought to rest, and the "stratified alloy" removed from the centrifuge.

The sample can then be sectioned into slices perpendicular to the axis of the original sample cylinder. The cross-sectioned slices are preferably characterized by x-ray diffraction to identify phases and by an ion microprobe to determine overall compositions of the slices. Other methods such as X-ray spectroscopy, EDS and Auger spectroscopy can also be used. The pure eutectic liquid will be located in the last "strata" which undergoes solidification. This "strata" will be characterized by the presence of all phases (two phases, Au and Si in the example here) in one stratified section. This is the eutectic alloy.

The principle of the technique remains the same for the case of the ternary or quaternary eutectic alloys. If n is the order of the alloy (e.g. binary, ternary, etc.), then a eutectic point will be characterized by the existence of n crystalline phases in equilibrium with the liquid. Generally speaking, the strata which contains all n-phases will be the eutectic composition centrifugally segregated and solidified alloy. By this method, one can physically isolate and identify the eutectic composition in a higher order alloy by centrifugal processing of an arbitrary starting alloy provided only that the starting alloy lies somewhere in the n-phase crystalline coexistence region in the low temperature phase diagram. In other words, the arbitrary starting alloy preferably includes n crystalline phases when the alloy is below the solidus temperature.

Purification of a Melt Containing Foreign Solid Particles Such as Oxides

As case examples of melt purification with respect to oxides, considered below are representative examples of practical interest. There has been much effort devoted to synthesizing bulk metallic glasses base on Fe. One of the most successful approaches to date has been to use a boron-oxide flux ($B_2O_3$) to suppress the effects of oxide particles in inducing crystallization of glass forming Fe-based.

Figure 4:
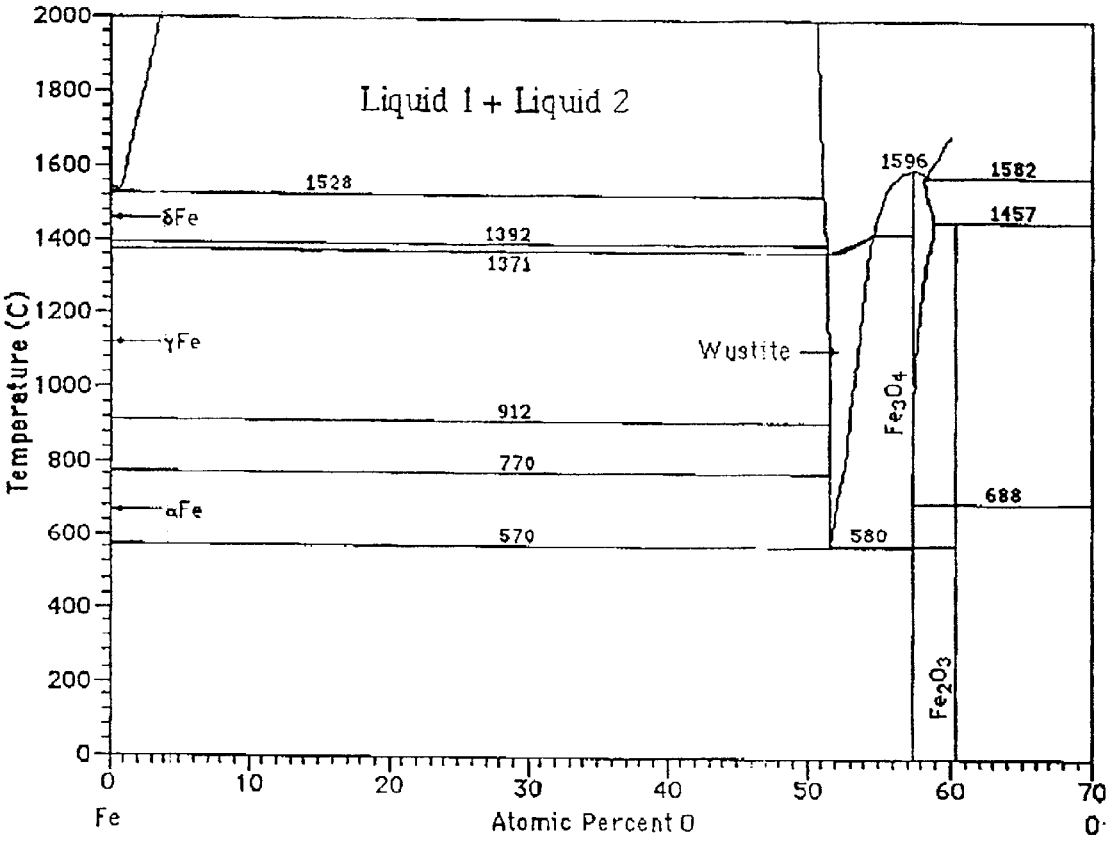
FIG. 4 is a phase diagram of the Fe—O system.

The problem can be understood by reference to the Fe—O binary phase diagram shown in FIG. 4. The phase diagram shows a very high-temperature liquid miscibility gap. At temperatures below 1500° C., even iron alloys containing small levels of oxygen undergo liquid phase separation. Extrapolation of the miscibility gap to much lower temperatures (less than 1000° C.) suggests phase separation of alloys containing oxygen in the tens of ppm range. Phase separation produces an oxygen rich melt containing roughly 50 at. % oxygen. This melt readily crystallizes to the Wustite phase (a roughly equi-atomic oxide of iron). The Wustite phase in turn catalyzes nucleation of other crystalline phases (e.g. crystalline phases of Fe or other intermetallic phases in the case of higher order alloys). The oxygen rich melt and the Wustite particles have substantially lower density (about 5.7 g/cc for the Wustite phase) than liquid iron (about 7.2 g/cc). The difference is actually over 20% (by comparison with the 10% used in the illustrative calculations above).

Both the oxygen rich melt as well as Wustite crystallites can be removed from the remaining alloy (Fe-rich) by use of centrifugal separation. The method is based on the sedimentation behavior described above. The alloy is slowly cooled step-wise from high temperature until the liquid miscibility gap is traversed. Phase separation produces an oxygen rich liquid phase (or Wustite crystal as the case may be) which can be removed by a g-force to a remote location from the remaining Fe-rich melt. The primary requirements are that the oxygen rich phases coarsen to a size in the 0.001 to 1 $\mu$m (or larger) range and that the melt be processed for time scales on the order of hours or days, depending upon the size of the particles and the exact time scales from equation (5) above.

Under these circumstances, the remaining melt will be "purified" of oxygen rich liquid phase, of Wustite particulate debris, and of heterogeneous nucleation sites for crystals. Removal of crystalline Wustite particles down to nm sizes can be accomplished in time scales of hours/days. The method can be applied to more complex Fe-based alloys containing a substantial fraction of Fe (typically greater than 70 at. % Fe). The principal of the method remains the same to remove oxygen rich phases (both liquid and crystalline) from the remaining liquid alloy to decontaminate the melt of heterogeneous nucleation sites. This method is equally applicable to remove impurities, including but not limited to oxide and carbide particles, from alloys other than Fe alloys. These impurities are not nominally intended to be present in the alloy but arise from the lack of purity of materials from which the alloy is made.

Casting of a Bulk Metallic Glass Component

Once a metallic alloy has been identified and/or purified using the methods described above, casting of metallic glass components from purified low melting liquids can be carried out in at least one of two general ways. These can be referred to as "ex-situ" and "in-situ" casting, as described below.

Ex-situ Casting. In one embodiment the alloy can be solidified entirely in the centrifuge following the initial processing steps of (1) isolating the low melting eutectic composition, and (2) purifying this low melting alloy of crystalline debris (oxides, carbides, etc.) which acts to catalyze heterogeneous crystal nucleation. The isolated/purified melt is cooled by shutting down the power to the furnaces on the centrifuge while maintaining rotation. The centrifuge itself is shut down once the solidified alloy has been cooled to ambient temperature. The cooling of the alloy to ambient temperature preferably occurs at a rate sufficient to suppress crystallization of the alloy. Thus, the purified eutectic or low melting alloy that is removed from the centrifuge is preferably an amorphous metal, and can be used as a feed stock for a traditional casting process.

In-situ Casting. The purified and isolated low melting point alloy can be directly cast into a net shape component. In this case, a casting gate is preferably provided at the appropriate location in the sample column. This location is situated at a position on the column where the purified eutectic melt is located. In practice, the low melting or eutectic alloy is first identified by a series of initial centripetal experiments aimed at isolating and identifying the lowest melting alloy as described above. An alloy of this nominal composition is then used as feedstock for the centripetal casting. The optimized feedstock material is melted in the centripetal furnace. It is then purified of any oxide or other crystalline debris (using the above methods). A gate is provided which carries the melt to a metal mold or die from a location in the melt column which is far removed from regions where the crystallize debris has sedimented. The melt that is removed through the gate preferably is transferred to the mold or die while still at or near its eutectic temperature. Once in the mold, the alloy can be cooled at a rate sufficient to suppress crystallization, thereby forming an amorphous metallic alloy.

The above descriptions outline the features of the general approach to be used. Additional details regarding casting of amorphous metallic alloys are described in U.S. Pat. Nos. 5,950,704, 5,711,363, and U.S. application Ser. No. 09/879,545, filed Jun. 11, 2001, the entirety of each of which is hereby incorporated by reference.

Components cast using the methods above preferably can be made in bulk (e.g., having a smallest dimension exceeding about 1 mm). The components preferably have a glassy or amorphous structure which was produced using the centripetal processing method either by the "in-situ" or "ex-situ" casting methods described above. A "bulk" cast component can also be made having a partially amorphous or glassy structure. More preferably, one embodiment of a bulk cast component has at least 20 volume % amorphous phase in its microstructure. Preferred embodiments also describe the production and manufacture of large net shape castings, plates, rods, and other useful shapes from the purified and compositionally optimized liquid alloy.

Preferred Centrifuge Devices

As discussed above, a method for identifying and processing metallic glass forming alloys and fabricating components thereof using large inertial forces to process liquid metal alloys at high temperatures (in the molten state) has been provided. This method is preferably implemented using a centrifugal processing platform. The implementation of the method preferably uses acceleration or g-forces. Here, an acceleration of 1 g is the acceleration of earth's gravity (9.8 $m/s^2$). Accelerations ranging from about $10^3$ g ($9.8\times10^3$ $m/s^2$) up to values as high as about 1 mega-g or about $10^6$ g in the processing of liquid metal alloys are preferred.

To implement this method, a device preferably includes: (1) a centrifugal device/platform capable of generating and sustaining inertial accelerations up to the mega-g b range ($10^5$–$10^6$ g's); (2) a centrifugal device capable of holding or containing both a solid or liquid metal alloy sample on the centrifugal platform during rotation; (3) the capability to heat the metal alloy sample to temperatures above its melting temperature while subjecting the molten alloy to large inertial accelerations (mega-g) for sustained periods of time (preferably from tens of seconds up to tens of hours); and (4) the capability to control the environment in which the molten alloy is processed. Specifically, to implement the method optimally, one needs to process the molten metal in either a vacuum on a controlled gas atmosphere. As such, the liquid alloy should be situated in a controlled vacuum or gas atmosphere environment during processing at high g accelerations.

The actual temperature requirement (3) will depend upon the melting temperature of the alloy in question. In certain preferred embodiments, commercially useful structural metals such as aluminum, titanium, iron, nickel, copper, etc. can be used. The typical range of melting temperatures will fall between about 400° C. up to about 1200° C.

For requirement (4), the entire apparatus is preferably located in a hermetically sealed container, or the alloy samples are encapsulated in a hermetically sealed container which can be mounted on the centrifuge and which can remain sealed when subjected to high temperatures and large inertial accelerations (up to the mega-g range).

To the inventor's knowledge, there are no commercially available centrifuges or centrifugal devices which support all of these requirements. Requirement (3) is particularly challenging as the combination of high temperature and large inertial forces will challenge the mechanical integrity of the rotating centrifugal platform (hereupon called the rotor).

To overcome these difficulties, a high temperature centrifugal device is provided which offers the capability of processing high melting point liquids under mega-g range (about $10^5$–$10^6$ g) accelerations for extended times in a controlled environment.

High Temperature Rotor

The proposed device can be realized in several ways. An exemplifying realization comprises a rotor constructed of a suitable high temperature material. Here, a high temperature material is a material which maintains a suitable level of strength, resistance to deformation, and resistance to fracture and failure at an elevated temperature when subjected to the high stress loads associated with mega-g range accelerations. Examples of suitable rotor materials include, but are not limited to, high temperature steels such as Inconel alloys; Ni-based super-alloys (such as used for rotating jet engine components); toughened high temperature ceramics, such as alumina, zirconia, magnesia or yttria; and vitreous or pyrolytic carbon.

All of these materials are known to have significant strength and toughness at elevated temperatures. For example, Inconel alloys can have yield strengths of about 500 MPa at temperatures as high as 900° C. Vitreous carbon, or glassy carbon rods, crucibles, and components are known to have failure strength as high as 600 MPa at temperatures ranging up to 1500° C. A monolithic rotor is preferably fabricated from one of these high temperature materials.

Preferred rotors will be fabricated of a high temperature material having high strength and fracture resistance at temperatures of about 400–1200° C. which is capable of withstanding inertial accelerations up to at least 100,000 g's. These rotors can preferably be spun at high rotation frequencies of about 1000 to 100,000 rpm. In one embodiment, the rotor is capable of withstanding accelerations up to about 50,000 g's at the rotor perimeter, more preferably up to about 100,000 g's, and even more preferably up to about 250,000 g's.

Figure 5A:
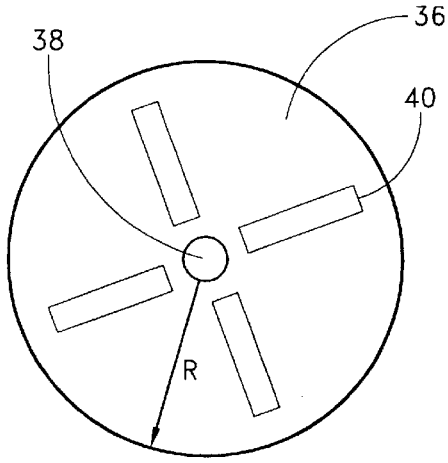
FIGS. 5A, 5B and 5C are schematic illustrations of various rotor designs that can be used in preferred centrifuge assemblies.
Figure 5B:
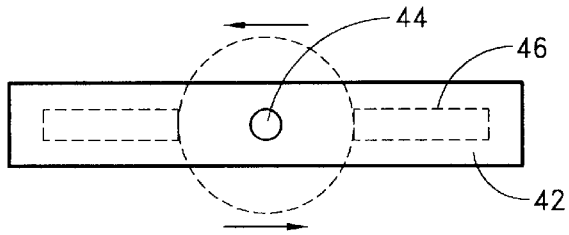
Figure 5C:
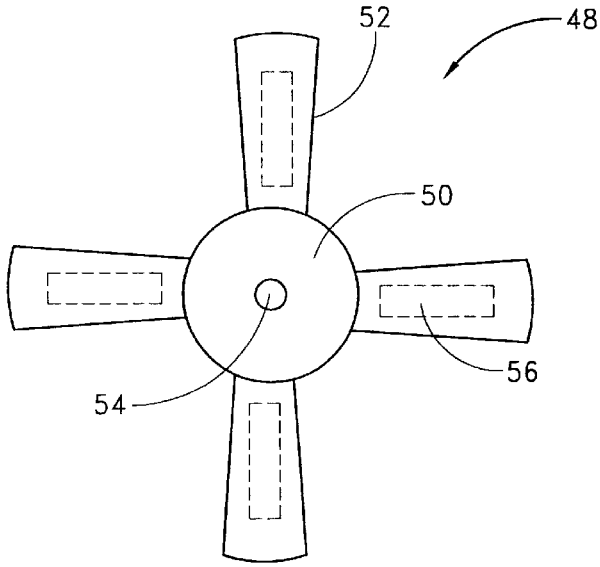

Simple illustrations of preferred rotor components are shown in FIGS. 5A–5C. FIG. 5A illustrates a disk rotor 36 mounted on a shaft 38. FIG. 5B illustrates a rod rotor 42 mounted on a shaft 44. FIG. 5C illustrates a hub rotor 48 having a plurality of blades 52 mounted on a central hub 50 rotating about a shaft 54. In each of these embodiments, the rotor is a monolithic fixture of symmetrical shape which is balanced in order to spin at high frequencies on a shaft without vibration. This is a common requirement for all preferred centrifuges.

The rotors of FIGS. 5A–5C each contain internal cavities for holding a sample alloy. The cavities are laid out within the rotor in a symmetric arrangement. For example, four cavities 40 are shown in FIG. 5A, two cavities 46 are shown in FIG. 5B, and four cavities 56 are shown in FIG. 5C. It will be appreciated that 2, 3, 4, 5, 6, 8, or any other numbers of cavities in a symmetrical arrangement could be used. The number of cavities to be used will depend on the overall mechanical load requirements to which the overall rotor will be subjected.

The presence of the cavities will reduce the maximum load that to rotor can withstand and thus reduce the maximum rotation frequency the rotor can support. As such, the cavities should generally be relatively "small". For example, if the rotor is as shown in FIGS. 5A–5C and has a radius R and thickness t (normal to the page), and the cavities are cylindrical with diameter d and length L, then D/t is preferably small, more preferably less than about 0.5. L/R is also preferably small, more preferably less than about 0.6, in order to maintain sufficient mechanical integrity of the rotor under the stress load imparted by rotation.

When the rotor is in the shape of a rod such as in FIG. 5B, the rotor may have a circular, circular, square, rectangular, or other shaped cross section. The rod 42 is preferably spun about a shaft 44 oriented normal to the principal (long) axis of the rod and located at center of the rod. The rod 42 preferably contains two internal cavities 46 located between the shaft and the ends of the rod. The rod/cavity assembly can be spun about the shaft at elevated temperatures (preferably about 400–1200° C.) whereby the ends of the rod sustain inertial accelerations of at least 50,000 g and preferably up to about 250,000 g or more.

The rotor of FIG. 5C preferably has blade-like protrusions 52 extending from a central hub. Each protrusion contains a sample processing cavity 56. This rotor is preferably shaped for optimization of the maximum attainable inertial accelerations.

The rotors of FIGS. 5A–5C preferably span a length of between about 10 cm to about 3 meters. In other words, this length corresponds to the diameter of the disk in FIG. 5A or the length of the rod in FIG. 5B.

Sealed Sample Capsules and Crucibles

Figure 6B:
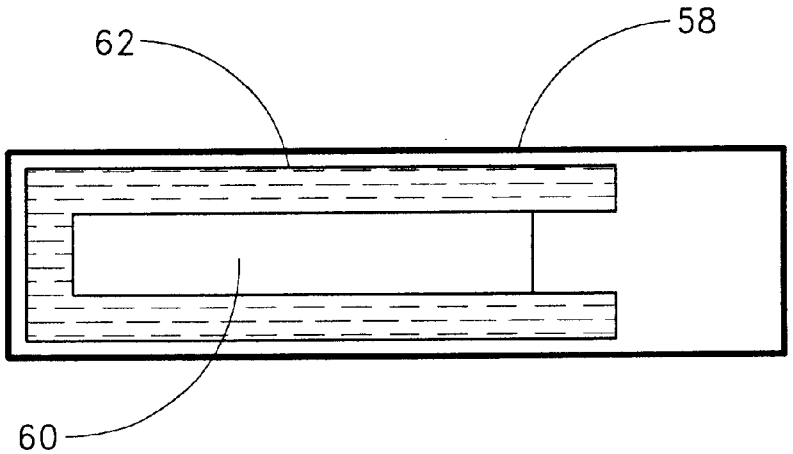
FIG. 6B is a cross-sectional view of a sample capsule having a crucible for containing a liquid alloy sample.
Figure 6A:
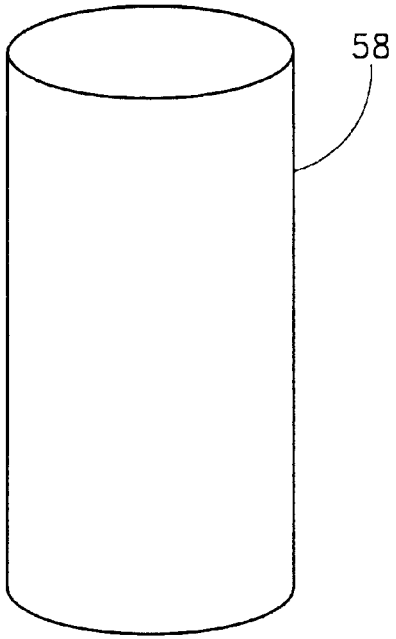
FIG. 6A is a perspective view of a hermetically sealed capsule used for containing a liquid alloy sample.

The cavities of FIGS. 5A–5C are used to accommodate samples to be processed. The samples themselves are preferably housed within hermetically sealed capsules 58, such as shown in FIGS. 6A and 6B. The liquid alloy sample 60 to be processed is preferably contained either directly in the capsule 58, or in a crucible 62 housed within the capsule such as shown in FIG. 6B. The liquid alloy sample 60 is sealed within the capsule 58 either under vacuum or under an inert gas atmosphere. The capsule 58 may contain the alloy sample directly (no crucible) provided that the reactivity of the subject sample in the molten state with the capsule material is not severe so as to either contaminate the sample or degrade the mechanical integrity of the hermetically sealed capsule (e.g. failure of the capsule hermetic seal).

When reactivity is of concern, a suitable crucible should be used to contain the alloy. The crucible can be made from a variety of suitable materials, including but not limited to fused silica, vitreous carbon, a refractory metal or ceramic material such as alumina or zirconia. In one preferred embodiment, the crucible 62 can be made of manganese.

The hermetically sealed sample capsule is preferably made of a material which can support large inertial stresses (typically about 10–500 MPa) at elevated temperatures (about 500–1500° C.) and should be suitable for convenient hermetic sealing of the crucible and alloy sample under either vacuum or inert gas. Examples of a suitable capsule include, but are not limited to an Inconel or high temperature steel capsule which can be sealed by welding caps onto a cylindrical crucible in a controlled environment (for example e-beam welding under vacuum or inert gas), a silica capsule which could be vacuum sealed by glass blowing, a Ni-based super alloy, and a refractory metal such as molybdenum.

Figure 7:
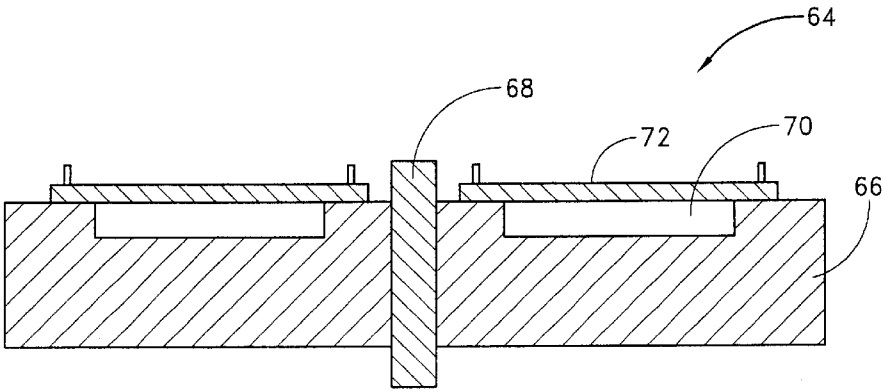
FIG. 7 is a cross-sectional view of a covered cavity design for loading sample capsules into a centrifuge assembly.

A convenient means of loading the sample capsules into the rotor cavities is preferably provided. For this purpose, various rotor designs can be employed. An example of a covered cavity design is shown in FIG. 7. The centrifuge assembly 64 shown in FIG. 7 preferably includes a rotor 66 which can be designed in accordance with the embodiments of FIGS. 5A–5C, or other embodiments, and a drive shaft 68. The sample 60 (not shown) is loaded into a sample cavity 70 lying just beneath the upper surface of the rotor 66, and a cavity cover 72 is releasably fastened to the rotor 66 to seal the cavity.

Figure 8:
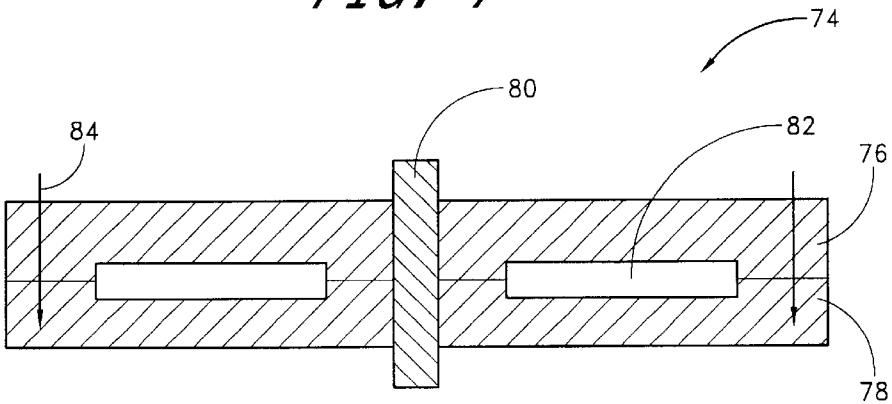
FIG. 8 is a cross-sectional view of a split rotor design for loading sample capsules into a centrifuge assembly.

Another example of a suitable rotor cavity design is shown in FIG. 8. Here a split rotor design is provided to give access for loading sample capsules. The assembly 74 includes a rotor split along the horizontal plane into two plates 76 and 78, and a rotor drive shaft 80. Sample cavities 82 are disposed in the surfaces of the components which face each other. Fasteners 84 are preferably used to seal the components together.

It will be appreciated that the embodiments of FIGS. 7 and 8 are merely two possible configurations for providing access for loading samples into a rotor cavity and are not intended as complete list of possible configurations. In evaluating the merits of various configurations, the mechanical integrity of the rotor should be taken into account. Both of the above configuration provide reasonable designs. Further embodiments are described below.

Method of Heating Rotor and Control of Rotor Temperature

To implement the centrifugal processing method, a means is preferably provided to heat the entire rotor assembly containing the sample capsules. Various methods can be employed. In one embodiment, similar to the testing of rotating aircraft components at elevated temperatures characteristics of component service, rotating components are "spin tested" in a furnace. In this method the entire rotor and shaft assembly are inserted into the furnace and heated to the ambient temperature of the furnace. Ni-based super-alloy and Inconel components are routinely tested to temperatures of up to about 1000° C. using this method.

In preferred embodiments, the rotor containing cavities and sample capsules can be inserted into a furnace. In contrast, one can also raise a cylindrical furnace up over the rotor. The furnace can be preheated or heated following insertion of the rotor. In either case, the entire rotor assembly will ultimately be heated to the steady state temperature inside the furnace. Using this method, the rotor assembly is heated to temperatures sufficient to melt the sample alloys inside the capsules. As the sample capsules are essentially enclosed in a blackbody cavity, the sample temperature will rapidly equilibrate to the rotor temperature. The rotor and samples can be spun up to maximum rotation frequency of the rotor and the samples processed under high inertial accelerations.

Using an Inconel or super-alloy rotor, calculations show that accelerations of about 1 to 2 times $10^5$ g can be achieved at temperatures up to about 1000° C. The rotor can then be removed from the furnace or the power to the furnace can be reduced to provide gradual cooling of the rotor and encapsulated samples. Thus, solidification can be carried out during the continued application of the high g acceleration.

As an alternative to the above method, the rotor can be heated by providing a heating source for the rotor. For example, the rotor can be heated while spinning using RF induction heating. Here, RF coils would be used in a configuration surrounding the rotor. When driven by an RF power supply, the RF coils couple to the metal rotor and RF power is coupled directly to the rotor. By adjusting the intensity of the RF power, one can achieve varying "steady state" rotor temperatures. This method can be readily implemented to heat an electrically conducting rotor to temperatures ranging to 1200° C. or higher where heat loss from the rotor is primarily by radiation. For a metal rotor of high thermal conductivity, the rotor will achieve a relatively uniform temperature in steady state. Likewise, the samples encapsulated within the rotor will achieve near isothermal conditions as required for processing liquid alloys at a well defined temperature.

Other methods in addition to inductive heating and resistive heating can be used to heat the rotor assembly. Alternatively, one could utilize a laser to heat the rotor assembly. Here, relatively high powered laser would be required. Other heating methods include direct resistive heating of the rotor. In this case, a high current rotating electrical feed-through would be required to bring current from an external power supply into the rotating rotor assembly. All of the above heating methods can be used to implement the preferred embodiments of this invention.

For processing liquid metal alloys, it will also be desirable to know the temperature of the samples (e.g. the rotor) as a function of time and acceleration history in order to control the processing of the liquid metal under high g acceleration. To measure the temperature of the rotor during processing, several methods can be employed. These include the use of an infrared or optical pyrometer to externally monitor the rotor temperature during processing, and the use of one or more calibrated thermocouples mounted on the rotor with junctions located within the sample cavities, preferably in direct contact with the samples. To utilize thermocouples, a rotating electrical connection is preferably used to feed the thermocouple signals to an external voltmeter or monitoring system. Either of the above methods would be effective for monitoring the sample temperature history during high g processing.

Experimental Results

Figure 9:
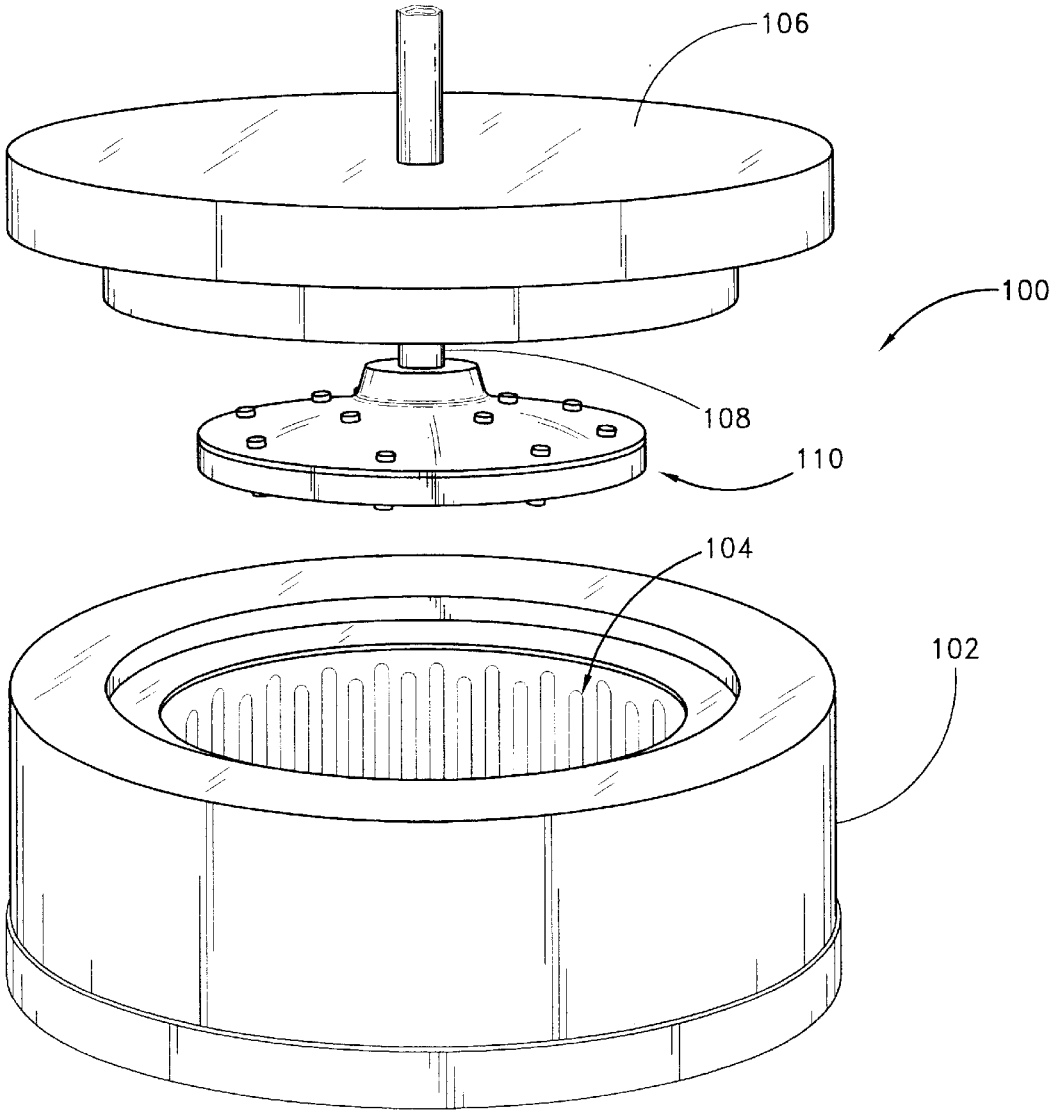
FIG. 9 is a perspective view of a centrifuge assembly according to one preferred embodiment.

FIG. 9 illustrates one preferred centrifuge assembly 100 that can be used to process glass forming metallic alloys. The assembly 100 includes a cylindrical body 102 enclosing a chamber 104, and a lid 106 provided over the body 102 for sealing the chamber. The cylindrical body 102 preferably acts as a furnace to control the temperature inside the chamber 104, and is capable of producing temperatures of up to about 1600° F. (about 875° C.) while the rotor (described below) is spun at rotation frequencies up to about 35,000 rpm, more preferably up to 1200° C. The body 102 and the lid 104 are preferably made from a suitable steel or ceramic material which can withstand the high temperatures without degradation. The sample chamber preferably has an internal diameter of about 30–60 cm.

Figure 10:
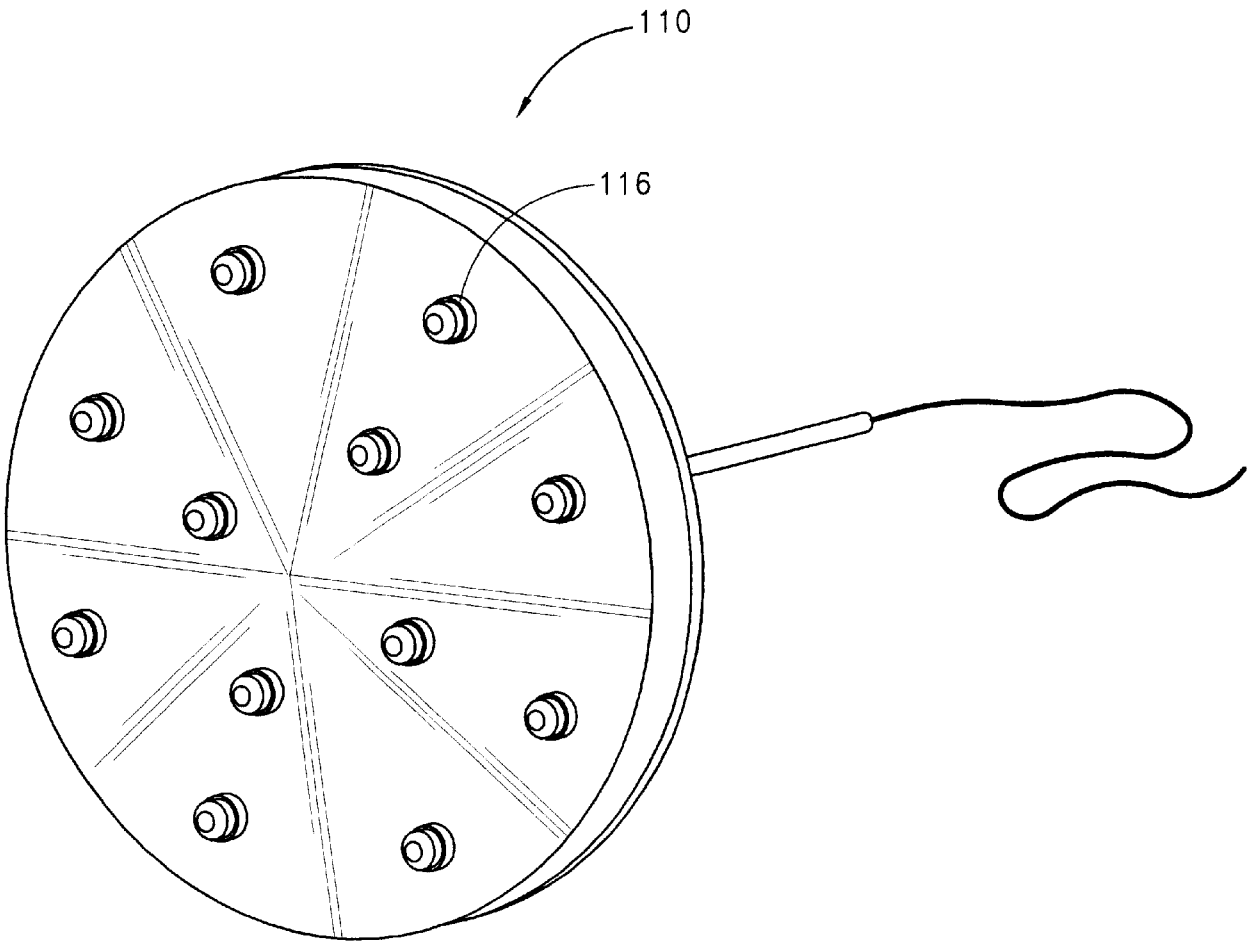
FIG. 10 is a perspective view of a rotor assembly used in the centrifuge assembly of FIG. 9.
Figure 11:
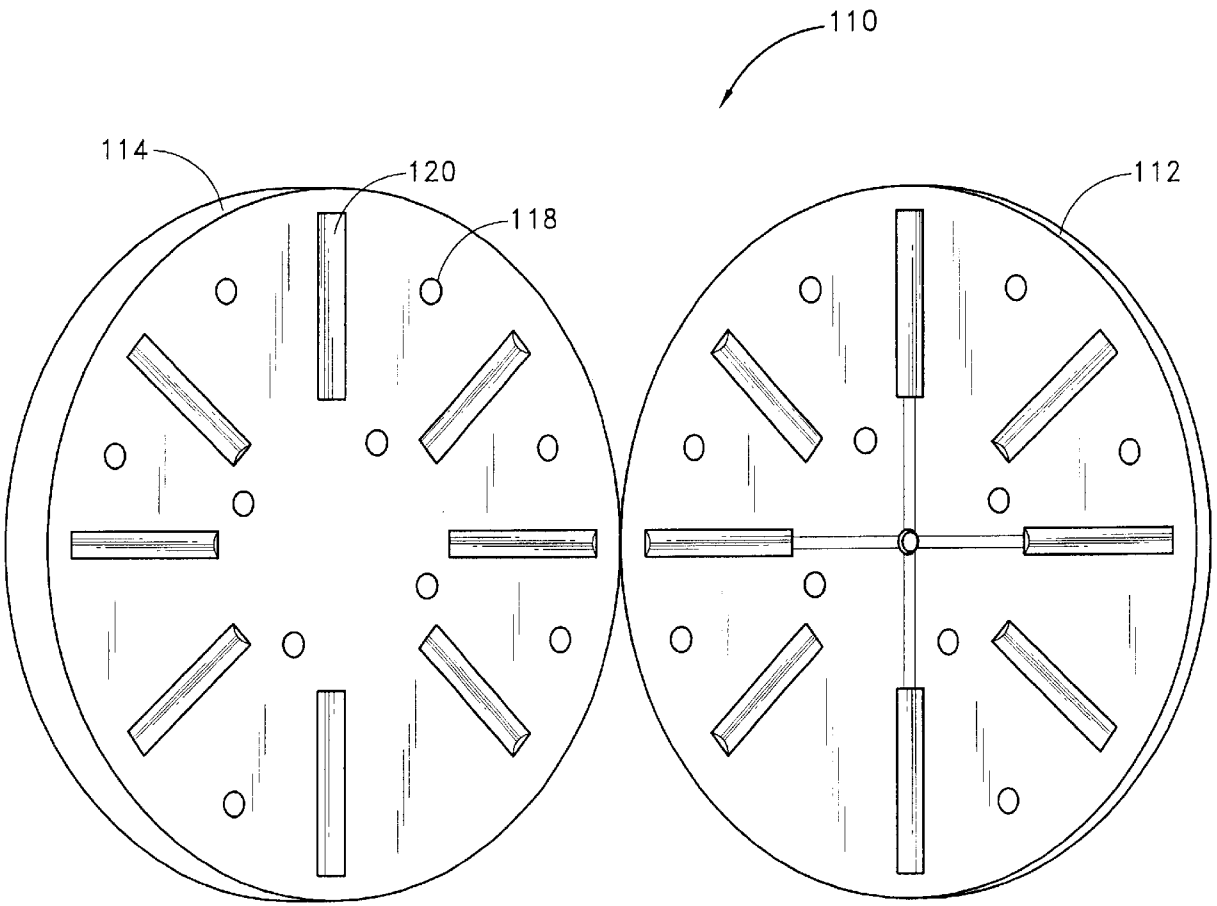
FIG. 11 is a perspective view of the rotor assembly of FIG. 10, shown open to illustrate the internal cavities.
Figure 12:
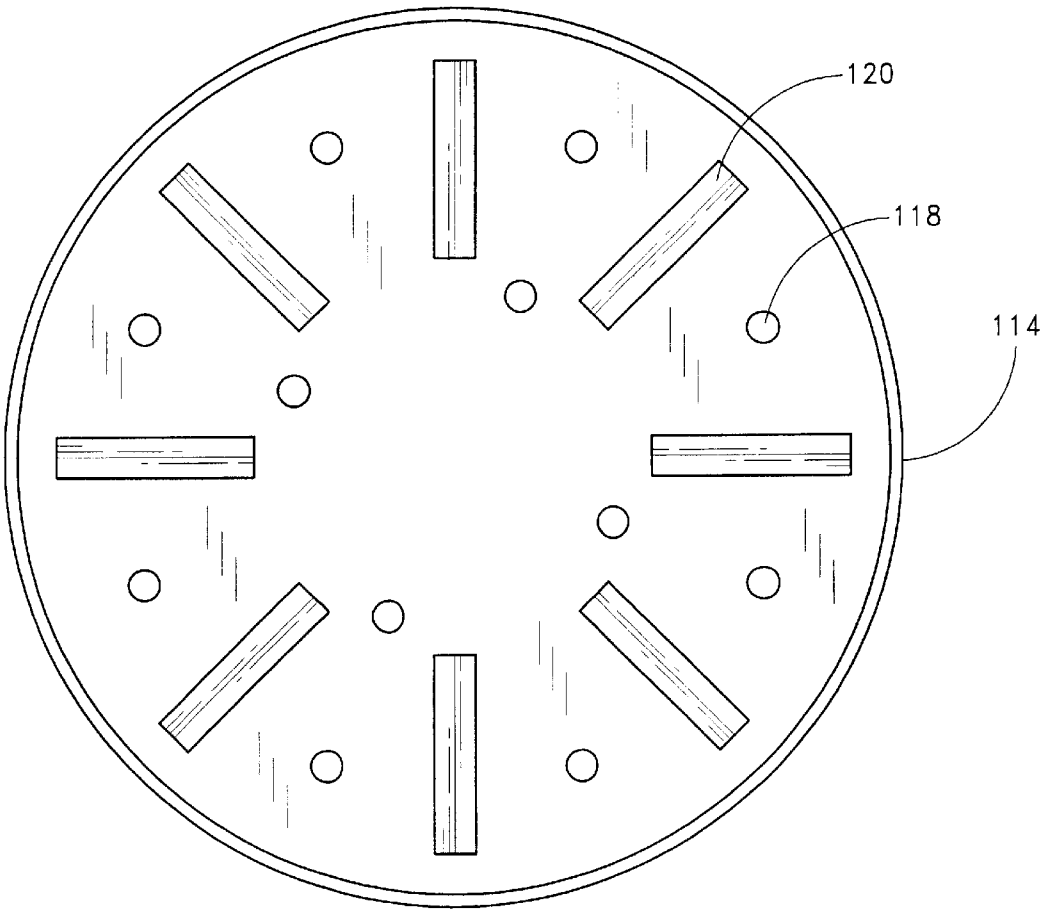
FIG. 12 is an end view of the internal surface of one of the plates forming the rotor assembly of FIG. 10.

Extending through the lid 106 of the furnace is a drive shaft 108. The drive shaft is constructed of a high temperature creep resistant alloy such as Waspalloy or Inconel 100. A rotor 110, described in further detail with respect to FIGS. 10–12, is provided at the bottom of the shaft. Thus, when the lid 106 is closed over the cylindrical body 102, the rotor 110 is provided inside the chamber 104.

As shown in FIGS. 10–12, the rotor 110 is comprised of two adjacent plates 112 and 114. As shown in FIGS. 11 and 12, the internal surfaces of each of these plates contains a plurality of recesses 120 for housing sample capsules such as described above. When the two plates are closed together, the recesses together define internal cavities for holding the sample capsules. As shown in FIGS. 11 and 12, eight cavities are provided in the rotor, although any number of cavities could be used. As shown in FIG. 10, the upper and lower plates of the rotor 110 are held together using fasteners 116 which extend through openings 118 in the plates.

The rotor is preferably made of a material which maintains an elevated strength (preferably greater than about 500 MPa) at elevated temperatures (preferably up to about 900° C. or higher) and resists creep under load at such temperatures. One preferred rotor is constructed from Inconel 100, although any of a number of materials such as described above can also be used. A Ni-based superalloy, or a pyrolytic carbon/carbon-fiber reinforced material would also be suitable for construction of the rotor. Other rotor components including the fasteners, sample capsules (contained within the rotor cavities) can also be fabricated from Inconel 100.

The overall disk shaped rotor (containing the sample cavities) in one embodiment has a preferred diameter in the range of about 10 cm to 50 cm. In one preferred embodiment, the rotor has a diameter of about 25 cm. The thickness of the rotor disk is preferably between about 1 cm and 5 cm, more preferably about 2 to 3 cm. The cavities within the rotor preferably each have a length of about 2 to 10 cm, more preferably about 5 cm, and a diameter of about 0.5 to 2 cm, more preferably about 1.27 cm. The rotor is preferably capable of accelerations up to about 60,000 g (600,000 $m/s^2$), more preferably up to about 200,000 g (2,000,000 $m/s^2$). One preferred device was tested at accelerations up to 120,000 g (at the outer end of the sample cavities). Cooling times of about 1 minute to 10 hours may be used, more preferably with cooling rates of about 0.001° C./second to about 10° C./second.

It should be understood that certain variations and modifications of this invention will suggest themselves to one of ordinary skill in the art. The scope of the present invention is not to be limited by the illustrations or the foregoing descriptions thereof, but rather solely by the appended claims.

What is claimed is:

1. A method of identifying the lowest melting eutectic composition of an alloy having "n" phases, where $n \geqq 2$, the method comprising:

providing an arbitrary starting alloy;

heating the alloy until it is substantially molten;

subjecting the molten alloy to a large inertial force for a period of time while maintaining its temperature above the alloy's melting point;

lowering the temperature of the alloy below the melting point while subjecting the alloy to a large inertial force, thereby causing nucleation and growth of a first solid phase within surrounding liquid, the first solid phase being subjected to the inertial force such that the first solid phase moves upward or downward within the surrounding liquid by sedimentation;

further lowering the temperature of the alloy while subjecting the alloy to said inertial force, thereby causing further nucleation and growth of additional solid phases, the additional solid phases being subjected to the inertial force such that the additional solid phases move upward or downward within the surrounding liquid by sedimentation, wherein the temperature is further lowered until the alloy is substantially completely solidified; and identifying the last solid phase to solidify, the last solid phase being stratified in a layer between earlier solidified solid layers, the last solid phase having the lowest melting eutectic composition.

2. The method of claim 1, wherein the arbitrary starting alloy has a composition lying in the n-phase coexistence region when the alloy is in a low temperature portion of the phase diagram.

3. The method of claim 1, wherein subjecting the alloy to an inertial force comprising subjecting the alloy to a centripetal acceleration in a rotating apparatus.

4. The method of claim 3, wherein subjecting the alloy to a centripetal acceleration comprises placing the alloy in a centrifuge.

5. The method of claim 3, wherein the centripetal acceleration is about 1 to $10^6$ g's

6. The method of claim 3, wherein the centripetal acceleration is about $10^5$–$10^6$ g's.

7. The method of claim 1, wherein identifying the last solid phase to solidify comprises using a method selected from the group consisting of X-ray diffraction, X-ray spectroscopy, EDS and Auger spectroscopy to identify the composition of the last solid phase.

8. The method of claim 1, further comprising cooling the alloy prior to identifying the last solid phase.

9. The method of claim 1, wherein lowering the temperature of the alloy from the molten state until the last solid phase solidifies occurs over a period of about 1 minute to 10 hours at a cooling rate of about 0.001° C./second to about 10° C./second.

10. The method of claim 1, wherein the alloy solidifies into a mixture having three or more phases.

11. The method of claim 1, wherein at least some of the solid phases include impurity phases, and wherein the last solid phase to solidify has fewer impurities relative to the remaining alloy.

12. The method of claim 11, wherein the impurity phases include oxide, carbide or nitride particles.

13. A method of producing a bulk sample of a lowest melting eutectic composition of an alloy, the method comprising:

providing an arbitrary starting alloy;

heating the alloy until it is substantially molten;

subjecting the alloy to a centripetal acceleration for a period of time while maintaining its temperature above the melting point;

lowering the temperature of the alloy while subjecting the alloy to a centripetal acceleration, the lowering of the temperature causing nucleation and growth of a first solid phase within surrounding liquid, the first solid phase being subjected to the centripetal acceleration such that the first solid phase moves upward or downward in the surrounding liquid by sedimentation;

further lowering the temperature of the alloy while subjecting the alloy to said acceleration, the further lowering of the temperature causing further nucleation and growth of additional solid phases, the additional solid phases being subjected to the acceleration such that the additional solid phases move upward or downward in the surrounding liquid by sedimentation, wherein the temperature is further lowered until the alloy is substantially completely solidified; and casting a bulk sample of alloy using material taken from the last solid phase to solidify.

14. The method of claim 13, wherein the arbitrary starting alloy has a composition lying in n-phase coexistence region when the alloy is in a low temperature portion of the phase diagram.

15. The method of claim 13, wherein subjecting the alloy to a centripetal acceleration comprises placing the alloy in a centrifuge or spinning rotor assembly.

16. The method of claim 13, wherein the centripetal acceleration is about 1 to $10^6$ g's.

17. The method of claim 13, wherein the centripetal acceleration is about $10^3$–$10^6$ g's.

18. The method of claim 13, wherein the centripetal acceleration is about $10^5$–$10^6$ g's.

19. A method of producing a bulk sample of a lowest melting eutectic composition of an alloy, the method comprising:

providing an arbitrary starting alloy;

heating the alloy until it is substantially molten;

subjecting the alloy to a centripetal acceleration for a period of time while maintaining its temperature above the melting point;

lowering the temperature of the alloy for a period of about 1 minute to ten hours while subjecting the alloy to a centripetal acceleration, the lowering of the temperature causing nucleation and growth of a first solid phase within surrounding liquid, the first solid phase being subjected to the centripetal acceleration such that the first solid phase moves upward or downward in the surrounding liquid by sedimentation;

further lowering the temperature of the alloy while subjecting the alloy to said acceleration, the further lowering of the temperature causing further nucleation and growth of additional solid phases, the additional solid phases being subjected to the acceleration such that the additional solid phases move upward or downward in the surrounding liquid by sedimentation, wherein the temperature is further lowered until the alloy is substantially completely solidified; and casting a bulk sample of alloy using material taken from the last solid phase to solidify.

20. The method of claim 13, wherein the solid alloy in equilibrium has three or more phases.

21. The method of claim 13, wherein casting a bulk sample of alloy comprises using the last solid phase to solidify as feed stock for casting.

22. The method of claim 13, wherein casting a bulk sample of alloy comprises directly casting at least a portion of the alloy containing the last solid phase to solidify into a mold.

23. A method of forming a metallic glass alloy, comprising:

melting a mulitcomponent alloy;

cooling the molten alloy in the presence of a centripetal acceleration, until a last solid phase solidifies; and subsequently forming an amorphous metal by cooling the last solid phase to solidify from an elevated temperature to ambient temperature at a rate sufficient to suppress crystallization.

24. The method of claim 23, which the multicomponent alloy contains two primary components.

25. The method of claim 23, which the multicomponent alloy contains three or more primary components.

26. The method of claim 23, comprising solidifying the alloy in the presence of a g field of between about 1 and $10^6$ g's.

27. The method of claim 23, wherein the alloy is contained in a centrifuge.

28. The method of claim 23, wherein the alloy is solidified at a rate of between about 0.001° C./second and 10° C./second.

29. The method of claim 23, further comprising using a portion of the solidified alloy as a feed stock for casting.

30. The method of claim 23, wherein the last solid phase to solidify is the lowest melting eutectic composition of the alloy.

31. The method of claim 23, wherein the alloy is contained in a sample column.

32. A method forming a metallic glass alloy, comprising:

melting a mulitcomponent alloy;

cooling the molten alloy in the presence of a centripetal acceleration, until a last solid phase solidifies; and subsequently forming an amorphous metal by cooling the last solid phase to solidify from an elevated temperature to ambient temperature at a rate sufficient to suppress crystallization, wherein the alloy is contained in a sample column which includes a gate for removing at least a portion of the alloy.

33. The method of claim 32, wherein the gate is located adjacent to a portion of the alloy which, upon solidification, contains relatively fewer impurities than the remaining alloy.

34. A method of forming a purified, multicomponent bulk metallic glass forming alloy, comprising:

(a) melting a sample alloy at an elevated temperature;

(b) subjecting the molten alloy to a centripetal acceleration while holding it above the melting point for a period of time;

(c) solidifying the alloy by lowering the temperature of the alloy while continuing to subject the alloy to a centripetal acceleration, the solidified alloy having a portion separated from the remaining alloy having a lowest melting eutectic composition;

(d) isolating the portion of the alloy having the lowest melting eutectic composition;

(e) re-melting the portion of the alloy having the lowest melting eutectic composition at an elevated temperature, while subjecting this portion to a centripetal acceleration; and (f) subsequently cooling the portion of the alloy having the lowest melting eutectic composition while subjecting the portion to a centripetal acceleration, the cooled alloy having a portion with relatively fewer impurity phases than the remaining alloy.

35. The method of claim 34, wherein the portion of the alloy having the lowest melting eutectic composition is contained in a sample column.

36. The method of claim 35, wherein the sample column includes a gate adjacent that portion of the cooled alloy having relatively fewer impurity phases.

37. The method of claim 36, further comprising removing that portion of the cooled alloy having relatively fewer impurity phases from the sample through the gate, and transferring the removed portion to a mold or die.

* * * * *